United States Patent [19]

Hamilton

[11] 4,354,369

[45] Oct. 19, 1982

[54] METHOD FOR SUPERPLASTIC FORMING

[75] Inventor: C. Howard Hamilton, Thousand Oaks, Calif.

[73] Assignee: Rockwell International Corporation, El Segundo, Calif.

[21] Appl. No.: 150,471

[22] Filed: May 16, 1980

[51] Int. Cl.[3] ..... B21B 9/00

[52] U.S. Cl. ..... 72/38; 72/60; 72/342; 72/364

[58] Field of Search ..... 72/38, 20, 364, 60, 72/342, DIG. 28

[56] References Cited

U.S. PATENT DOCUMENTS

| | | | |
|---|---|---|---|
| 3,340,101 | 9/1967 | Fields, Jr. et al. | 72/364 X |
| 3,516,274 | 6/1970 | Graham et al. | 72/57 |
| 3,920,175 | 11/1975 | Hamilton et al. | 228/173 |
| 3,927,817 | 12/1975 | Hamilton et al. | 228/157 |
| 3,974,673 | 8/1976 | Fosness et al. | 72/364 |
| 4,087,037 | 5/1978 | Schier | 228/157 |
| 4,197,777 | 4/1980 | Deminek | 228/157 |
| 4,233,829 | 11/1980 | Hamilton | 72/342 X |
| 4,233,831 | 11/1980 | Hamilton et al. | 72/60 |
| 4,266,416 | 5/1981 | Festag et al. | 72/60 |

*Primary Examiner*—Leon Gilden

*Attorney, Agent, or Firm*—H. Fredrick Hamann; Craig O. Malin

[57] ABSTRACT

A method is provided for eliminating internal voids in superplastically forming parts. A blank of material which is capable of being formed superplastically is held opposite a forming surface of a die. The blank is heated to the superplastic forming temperature and pressure is applied to both sides of the blank. This pressure is sufficient to prevent the formation of voids. The pressure on the side of the blank farthest from the die surface is then increased to superplastically form the material against the die surface. In a second embodiment, the pressure is applied after the blank has been formed either by maintaining the forming pressure to compress the material between the forming pressure and the reaction of the die, or by applying a fluid pressure to both sides of the part, thereby removing voids by plastic deformation and diffusion.

7 Claims, 5 Drawing Figures

METHOD FOR SUPERPLASTIC FORMING

BACKGROUND OF THE INVENTION

1. Field of the Invention

This invention relates to the field of material forming, particularly to material forming under superplastic conditions.

2. Description of the Prior Art

Under certain conditions, some materials can be plastically deformed without rupture well beyond their normal limits, a property called superplasticity. The usual process involves placing a sheet of material in a die, heating the material to a temperature at which it exhibits superplasticity, and then using a gas to apply pressure to one side of the sheet. Sufficient pressure is applied to strain the material at a strain rate which is within the superplasticity range of the material being formed at the selected temperature. This gas pressure creates a tensile stress in the plane of the sheet which stretches the sheet and causes it to form into the die cavity. This process is described in U.S. Pat. No. 4,181,000 to C. Howard Hamilton (of the present invention), Neil E. Paton, and John M. Curnow. The process is being used increasingly for forming different configurations such as titanium sheet metal structures for aircraft.

One undesirable characteristic of many superplastic alloys is their tendency to cavitate (form small internal voids) during the tensile deformation imposed by prior art forming operations. The voids limit the superplastic ductility of the material, as well as reduce its mechanical properties if they are present in a sufficiently large volume fraction. Unfortunately, the rate of cavitation is usually maximum when superplasticity is maximum, a problem which has limited the application of prior art superplastic forming methods.

SUMMARY OF THE INVENTION

It is an object of the invention to provide a method for eliminating or minimizing cavitation during superplastic forming.

It is an object of the invention to provide a method for eliminating or reducing voids in superplasticity formed parts.

It is an object of the invention to provide a method for superplastically forming parts using optimum strain rates without causing cavitation.

According to the invention, a pressure is applied to both sides of the blank either during forming or after completion of forming. If applied during forming, this method of pressure application reduces the magnitude of tensile stresses acting on the void nucleation sites thus preventing the formation of voids, or decreasing their size and number.

The hydrostatic stress component, or maximum tensile stress component, acting on a void or void nucleation site normally determines whether a void will nucleate and grow. Thus, if these stress components can be maintained below come critical level, then cavitation should not occur, or should be eliminated by closure if it had previously developed. While critical stress magnitudes for prevention and closure may be different, concepts for eliminating voids in both cases are the same for the invention.

The imposition of pressure applied to both sides of the blank adds a compressive hydrostatic stress component to that normally generated tensile hydrostatic stress component, providing a net hydrostatic component of reduced tension or even of compression. A similar rationale holds for the maximum tensile stress acting on void or void nucleation site. These concepts of stress state are well known by those schooled in the art. It is this modified stress state acting on the void or void nucleus which is effective in preventing or eliminating voids developed during superplastic forming. The reduced tensile stress or compressive hydrostatic stress is obtained by applying a gas pressure to both sides of a blank after it is placed in a forming die and heated to superplastic forming temperature. The pressure on the side of the blank farthest from the configuration die surface is then increased in a known manner to superplastically form the material against the die surface. Thus, cavitation is reduced or eliminated because forming is accomplished while the voids or void nucleation sites are subjected to reduced stresses.

If the pressure is applied after superplastic forming, then the resulting voids are removed by plastic deformation and/or diffusion. In this second embodiment, the blank is placed in a forming die, heated to a superplastic forming temperature, and then superplastically formed in a known manner by applying gas pressure to the side of the blank which is farthest from the die surface. After the blank is formed against the die surface, it is held there by maintaining the forming pressure. During this hold period, due to the action of the gas pressure and the reaction of the die, voids which may have formed during the earlier forming step are closed by plastic deformation and/or diffusion.

DESCRIPTION OF THE PREFERRED EMBODIMENT

Superplastic forming requires a material which is capable of exhibiting an effective value of strain rate sensitivity, m. The value of m is a function of temperature, material, microstructure, and strain rate. Methods of determining m and of determining optimum strain rates and forming temperatures are known, see for example previously mentioned U.S. Pat. No. 4,181,000.

Many superplastic alloys tend to cavitate (develop internal voids) while being formed under superplastic conditions. This problem has been attributed to a grain boundary sliding deformation mechanism which is common to both cavitation and to superplasticity. The cavitation in most superplastic alloys has been traced to initiation of particles existing on the grain boundaries which form voids at the particle-matrix interface as grain boundary sliding progresses. Once nucleated, these voids enlarge as deformation proceeds, eventually linking with other voids and thus leading to failure.

Cavitation has been observed in creep rupture failures of structural parts, and investigators have studied the nucleation and growth of voids under creep rupture conditions (tensile stresses applied for extended times at high temperatures) in order to understand the cause of these failures. The effect of hydrostatic pressure on void formation during creep rupture testing has been reported by D. Hull and D. E. Rimmer in *Philosophical Magazine,* vol. 4, page 673 (1959), and by R. T. Ratcliffe and G. W. Greenwood in Philosophical Magazine, vol. 12, page 59 (1965). These investigators tested wires under creep rupture conditions and studied the effects of hydrostatic pressure on cavitation. These tests showed that hydrostatic pressure could eliminate or reduce cavitation during creep rupture testing of wires. The present inventor has discovered that cavitation can be eliminated during superplastic forming by subjecting the material being formed to a hydrostatic pressure.

Figure 1:
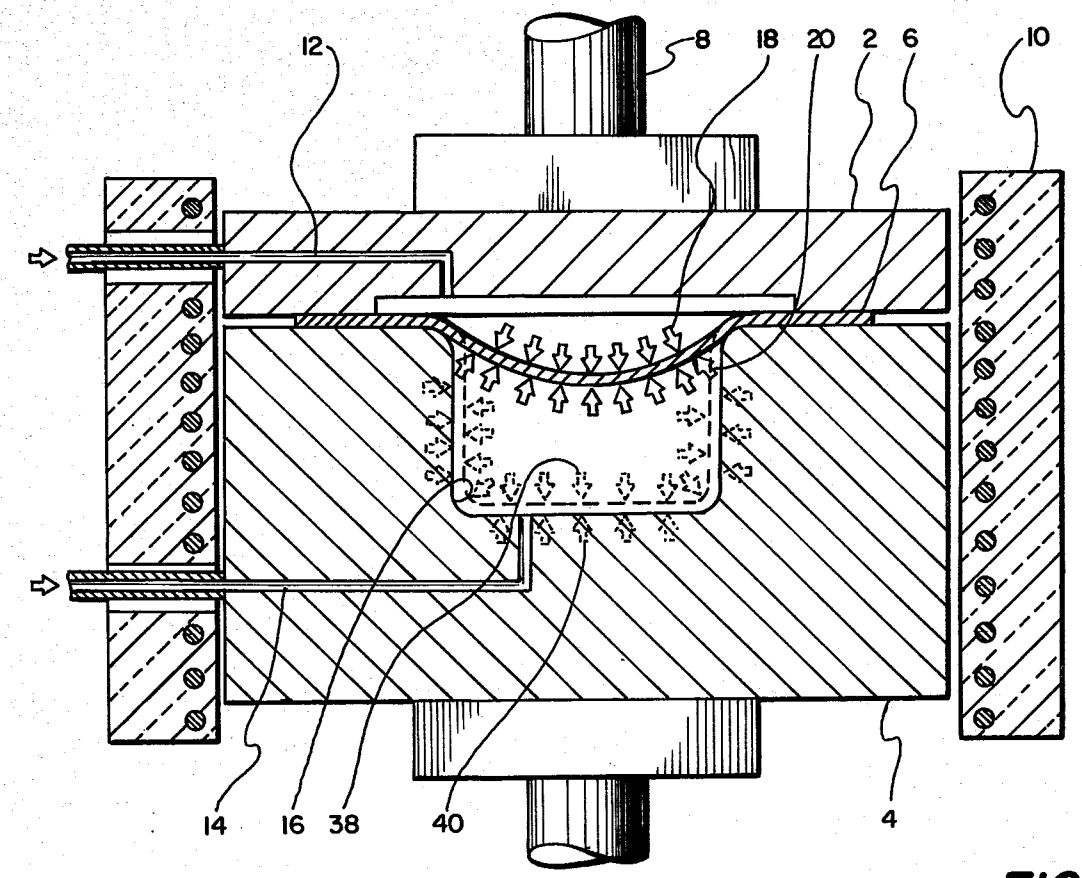
FIG. 1 is a cross section of a die and a blank illustrating the method of superplastic forming according to the invention.

FIG. 1 is a cross section of a die used to illustrate the method of the invention. The die has an upper portion 2 and a lower portion 4 between which is clamped blank 6 for forming. Clamping pressure can be applied by the ram 8 of a press. An insulated heater 10 surrounds the die and is used to raise the temperature of blank 6 to the forming temperature required to obtain superplastic properties.

Gas passages 12, 14 are provided for both upper die portion 2 and lower die portion 4. Lower die portion 4 has a forming surface 16 which creates a die cavity and defines the shape of the finished part such as the U-shaped channel shown in FIG. 1. Pressure is applied to both sides of blank 6 through inlets 12, 14 as shown by arrows 18, 20.

Figure 2:
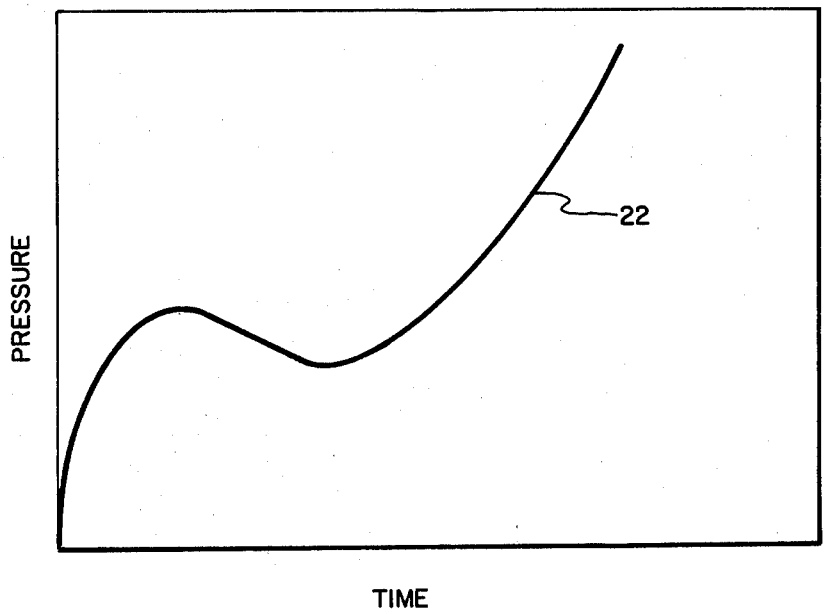
FIG. 2. ( PRIOR ART )
FIG. 2 is a typical time vs pressure profile for superplastically forming a U-shaped channel according to the prior art.

FIG. 2 shows a pressure vs time profile 22 which might be used for superplastically forming a blank according to the prior art. Gas would be introduced through inlet 12 (FIG. 1) to create a passage on the top surface of blank 6 in accordance with profile 22. No pressure would be applied to the side of the blank facing forming surface 16; rather, gas would be allowed to vent out of the die cavity as the blank moves down into the cavity. Although a part can be formed in such a manner, it may have numerous small voids resulting from cavitation.

Such cavitation can be prevented by following the method according to a first embodiment of the invention which utilizes a pressure during forming on both sides of blank 6 to create a component of reduced hydrostatic tensile or even compressive stress in blank 6. A blank of suitable material is placed between die portions 2, 6 so that it is opposite forming surface 16. It is heated to, and held at a temperature at which it exhibits an effective value of strain rate sensitivity.

Figure 3:
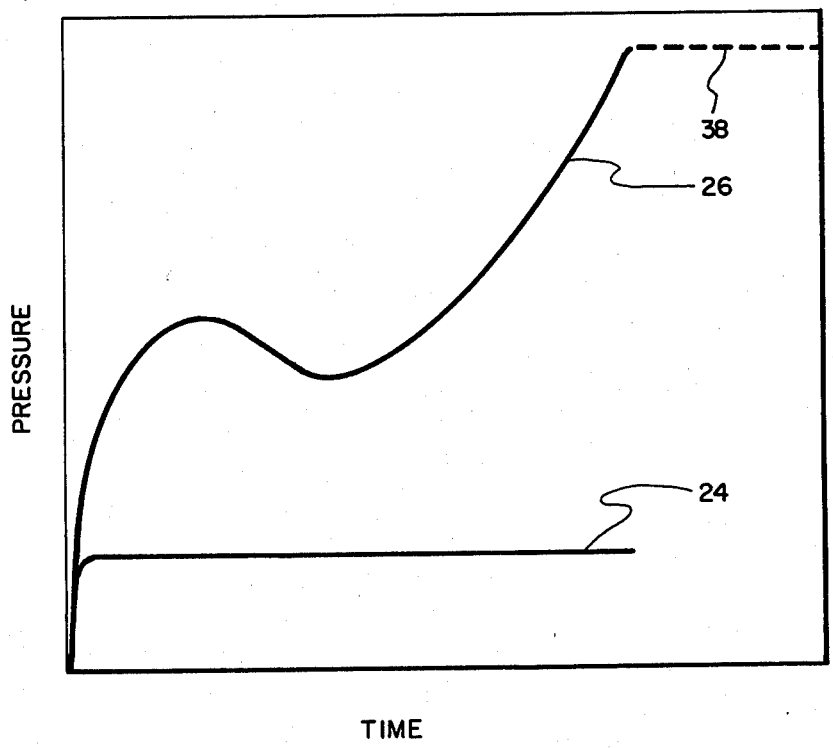
FIG. 3 is a time vs pressure profile for superplastically forming a U-shaped channel according to a first embodiment of the present invention.

Pressure is then applied to both sides of the blank by introducing gas through inlets 12, 14. FIG. 3 shows pressure vs time profiles 24, 26 for the side of the blank which faces forming surface 16 and for the opposite side of the blank, respectively. As shown in FIG. 3, the pressure on both sides is increased at about the same rate so that a hydrostatic compressive stress is applied on blank 6. When a hydrostatic compressive stress is reached which is sufficient to prevent cavitation, pressure 20 (FIG. 1) on the bottom side of blank 6 is held substantially constant as shown by profile 24. This back pressure can be estimated using calculations as discussed later, or it can be determined experimentally by running tests at various back pressures and then sectioning the parts to determine if cavitation has occurred.

Pressure 18 (FIG. 1) on the top side of blank 6 is increased as shown by forward pressure profile 26 in FIG. 3. Forward pressure profile 26 is shaped according to prior art techniques as required to obtain an effective value of strain rate sensitivity and form the parts as shown in FIG. 2. However, forward pressure profile 26, when compared to prior art profile 22, is raised overall to overcome the pressure from back pressure profile 24.

The minimum back pressure must be sufficient to create a sufficiently reduced tensile or increased compressive hydrostatic stress component acting on the void to prevent the formation of voids. This minimum stress depends upon the material being formed and upon the forming conditions, and it can be determined empirically. It can also be estimated using concepts which describe the applicable mechanism of flow and cavitation, such as the diffusional growth concept or the maximum tensile stress concept.

According to the diffusional growth concept, the minimum back pressure can be calculated from the theory of void formation by cavitation. One condition required for a void to be stable at a high temperature is:

$$(\sigma - P) \geqq 2\gamma/r, \text{ or } P \geqq \sigma - 2\gamma/r;$$

where:

$\sigma$ = hydrostatic tensile stress component imposed, acting on the void or void nucleous, P = hydrostatic pressure component acting on the void or void nucleous, $\gamma$ = surface energy at the void, and r = void radius.

Thus, as the hydrostatic pressure component (resulting from the back and forward pressure) is increased, the stable void size is increased and voids of smaller size will not form or will be eliminated. Since the void size is often related to the size of the particles (or inclusions) at the grain boundaries, it is possible to superimpose a hydrostatic pressure such that the stable void size is larger than the particles, thereby precluding the initiation of a cavity during deformation.

Figure 4:
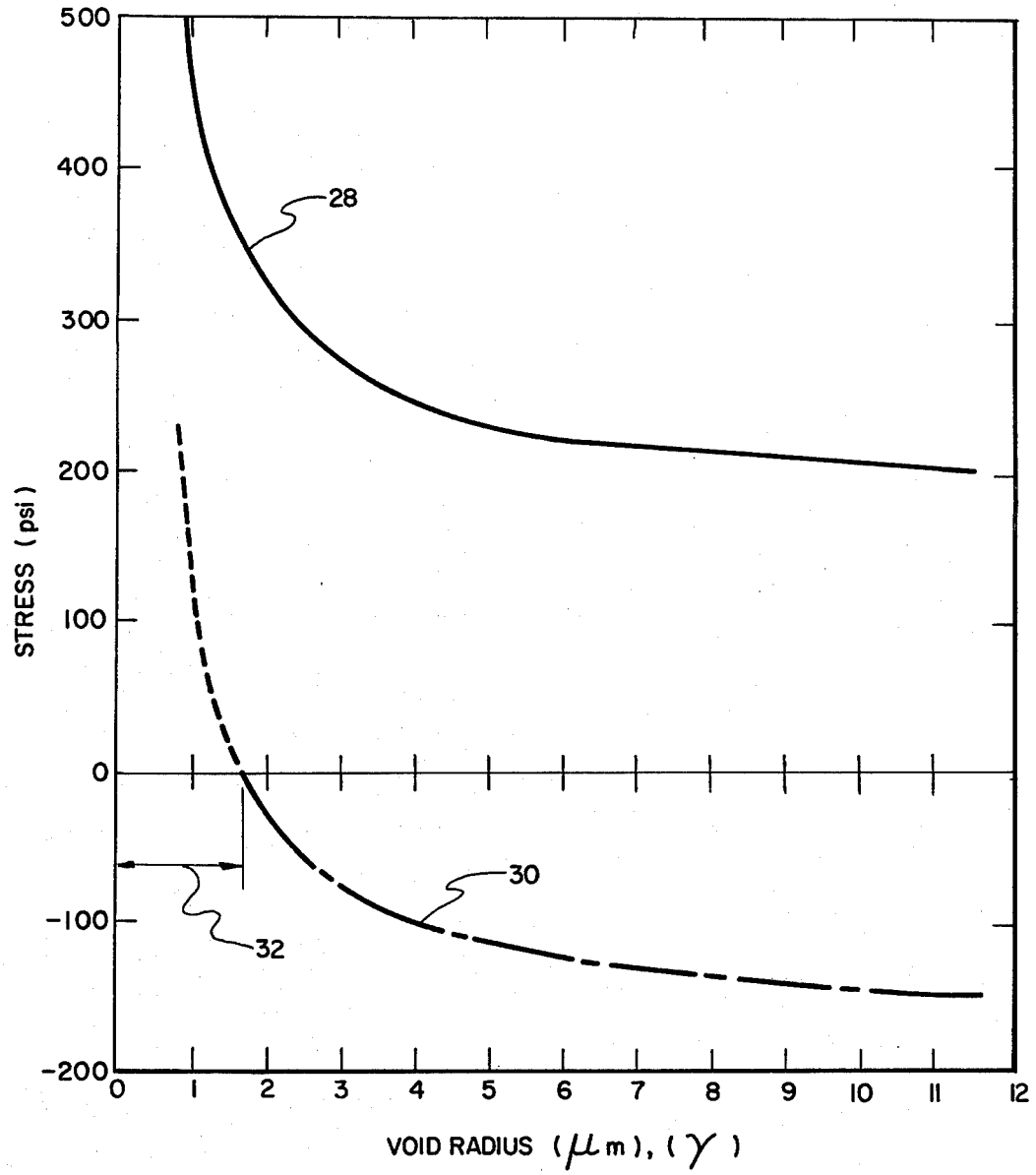
FIG. 4 is a pair of curves showing the stress state for suppression of voids as a function of void radius.

FIG. 4 shows the calculated stress state for suppression of voids of size 4 with concurrent forming at an effective strain rate, $\dot{\bar{\epsilon}}$, of $2\times10^{-4}s^{-1}$ and an effective forming stress, $\bar{\sigma}_f$, of 300 psi ($\bar{\sigma}_f = \sqrt{3}/2[\sigma_1 - \sigma_3]$). The calculations are for a sheet of 7475 aluminum alloy processed according to U.S. Pat. No. 4,092,181 by Neil E. Paton and C. Howard Hamilton so as to have a fine grain structure suitable for superplastic forming. The estimated surface energy of the voids, $\gamma$, is 1000 erg/cm$^2$; the forming temperature is 960° F. The tensile stress, $\sigma_1$, in the plane of the blank is shown by upper curve 28 and is related to the forward and back pressure as follows:

$$\sigma_1 = (P_1 - P_2)\rho/t,$$

where:

$\sigma_1$ = tensile stress in the plane of the blank, $P_1$ = forward pressure, $P_2$ = back pressure, $\rho$ = radius of curvature of the unsupported part of the sheet, and t = thickness of the sheet.

Lower curve 30 is the corresponding stress, $\sigma_3$, in the through-thickness direction of the blank. It is equal to back pressure $P_2$. As shown by arrow 32, no back pressure is required in this example for voids that have a radius smaller than about 1.7 μm.

In a second embodiment of the invention, the blank is formed in a prior art manner and voids are allowed to form as a result of cavitation. After forming is substantially complete, a post-forming compressive stress is applied to create a hydrostatic pressure state within the material and eliminate voids. The post-forming pressure closes the voids and diffusion bonds the void surfaces together.

Figure 5:
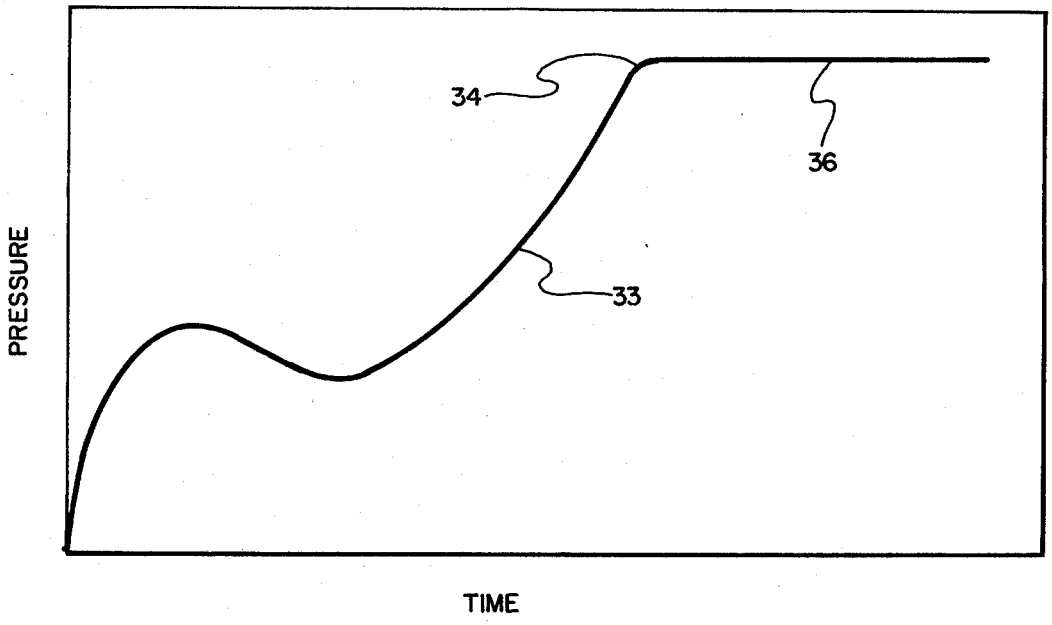
FIG. 5 is a time vs pressure profile for superplastically forming a U-shaped channel according to a second embodiment of the present invention.

FIG. 5 shows a pressure vs time profile 33 according to the second embodiment. The blank is formed by applying a forward gas pressure to the top side only in a prior art manner such as previously discussed. However, the forward pressure is not removed after the part is formed (point 34). Rather, the forward pressure is maintained while the formed part is in contact with forming surface 16 to provide post-forming pressure 36. This condition is represented in FIG. 1 by the dashed cross section of blank 6. The forward pressure shown by dashed arrows 38 creates a reacting pressure from die surface 16 as shown by dashed arrows 40. Thus, a back pressure is created without requiring a second pressuring gas.

Although FIG. 5 shows a constant post-forming pressure 36, the pressure can be increased in order to shorten the time required to close the voids. An optimum post-forming pressure and hold time can be determined experimentally by running tests at several pressures and time periods and then sectioning the part to determine what combination most efficiently removes voids.

In a third embodiment, the methods of FIGS. 3 and 5 are combined. Back pressure 24 can be applied during forming to reduce cavitation; and after forming, forming pressure 26 can be maintained as shown by dotted line 38 to close any voids which may have formed. Back pressure 24 can be maintained during this period or it can be reduced because the reaction of the die will provide the necessary back pressure. This combination embodiment may prove most economical in applications where the available equipment is not capable of providing sufficient back pressure to completely eliminate cavitation during the forming stage of the operation.

Examples of the method of the invention as applied to forming a 2 inch×6 inch×1 inch deep rectangular box are given below. The material is 0.040 inches thick 7475 aluminum alloy sheet processed according to U.S. Pat. No. 4,092,181 so as to have a fine grain structure suitable for superplastic forming.

EXAMPLE I

The material is placed in a die and heated to 960° F. The forward and back pressures are then increased together to 100 psi. The back pressure is held at 100 psi and the forward pressure is increased at a rate calculated to produce a strain rate, $\epsilon$, of $2\times10^{-4}s^{-1}$. After the part is formed, the forward and back pressures are reduced to ambient and the formed part is removed from the die.

EXAMPLE II

The material is placed in a die and heated to 960 F. The forward and back pressure are then increased together to 300 psi. The back pressure is held at 300 psi which is equivalent to the flow stress of the material at the strain rate used. The forward pressure is increased at a rate calculated to produce a strain rate, $\epsilon$, of $2\times10^{-4}s^{-1}$. After the part is formed, the forward and back pressures are reduced to ambient and the formed part is removed from the die.

The resulting part was well formed and subsequent metallographic evaluation revealed an absence of cavitation, even in the severely formed corners. Previous parts formed under similar conditions but without the back pressure showed significant cavitation.

Numerous variations and modifications can be made without departing from the invention. For example, a forward pressure can be applied to form a blank in a conventional manner. However, before forming is complete, sufficient back pressure can be applied to close voids which may have formed during the initial pressurization. The back pressure is then reduced and forming is continued under the forward pressure. If necessary to provide sufficient hydrostatic compressive stress, both the forward pressure and the back pressure can be increased temporarily to close voids before continuing the forming operation. The back pressure can be increased and reduced periodically during forming as may be required to most expeditiously eliminate voids for particular applications. Accordingly, it should be clearly understood that the form of the invention described above and shown in the accompanying drawings is illustrative only and is not intended to limit the scope of the invention.

What is claimed is:

1. A method of reducing cavitation during superplastically forming a blank of material, comprising the steps of:

providing a blank of material which exhibits an effective value of strain rate sensitivity at a forming temperature;

providing a die having a forming surface;

positioning said blank in said die opposite said forming surface;

holding said blank at said forming temperature so that said material exhibits said effective value of strain rate sensitivity;

applying positive pressure concurrently to both sides of said blank sufficient to prevent the formation of voids in said material; and increasing said positive pressure on the side of said blank farthest from said forming surface to develop tensile strain in said material at a rate which provides said effective value of strain rate sensitivity, whereby said blank stretches by said tensile strain toward said forming surface and forms against said forming surface without cavitation.

2. The method as claimed in claim 1 wherein said positive pressure applied to both sides of said blank is at least equal to $\sigma-2\gamma/r$, where $\sigma$ is the hydrostatic tensile stress component imposed during said positive step of increasing said pressure on the side of said blank furthest from said forming surface, $\gamma$ is the surface energy of the void, and r is the void radius which is selected to be larger than intergranular particles in the material.

3. A method of reducing cavitation which occurs during superplastically forming a blank of material, comprising the steps of:

providing a blank of material which exhibits an effective value of strain rate sensitivity at a forming temperature;

providing a die having a forming surface;

positioning said blank in said die opposite said forming surface;

holding said blank at said forming temperature so that said material exhibits said effective value of strain rate sensitivity;

applying positive pressure on the side of said blank farthest from said forming surface sufficient to develop tensile strain in said material at a rate which provides said effective value of strain rate sensitivity so that said material stretches by said tensile strain toward said forming surface and forms against said forming surface; and applying positive pressure on said farthest said of said blank after said blank has formed against said forming surface whereby voids in said material are removed by plastic deformation and diffusion.

4. A method of reducing cavitation during superplastically forming a blank of material, comprising the steps of:

providing a blank of material which exhibits an effective value of strain rate sensitivity at a forming temperature;

providing a die having a forming surface;

positioning said blank in said die opposite said forming surface;

holding said blank at said forming temperature so that said material exhibits said effective value of strain rate sensitivity;

applying positive pressure concurrently to both sides of said blank sufficient to retard the formation of voids in said material;

increasing said positive pressure on the side of said blank farthest from said forming surface to develop tensile strain in said material at a rate which provides said effective value of strain rate sensitivity so that said material stretches by said tensile strain toward said forming surface and forms against said forming surface; and maintaining positive pressure on said farthest side of said blank after said blank has formed against said forming surface to compress said material between said pressure and the reaction of said die, whereby voids in said material are removed.

5. A method of reducing cavitation during superplastically forming a blank of material, comprising the steps of:

providing a blank of material which exhibits an effective value of strain rate sensitivity at a forming temperature;

providing a die having a forming surface;

positioning said blank in said die opposite said forming surface;

holding said blank at said forming temperature so that said material exhibits said effective value of strain rate sensitivity;

applying a positive forward pressure on the side of said blank farthest from said forming surface sufficient to develop tensile strain in said material at a rate which provides said effective value of strain rate sensitivity so that said material stretches by said tensile strain toward said forming surface;

after said material begins stretching and while still applying said forward pressure applying a positive back pressure which is equal to or less than said forming pressure to the side of said blank opposite said farthest side to remove voids in said materials; and reducing said back pressure while continuing said forward pressure until said material forms against said forming surface.

6. The method as claimed in claim 5, wherein said step of applying a positive forward pressure includes raising said forward pressure during said step of applying a positive back pressure, and then reducing said forward pressure as said back pressure is reduced.

7. The method as claimed in claim 5, wherein said steps of applying and reducing back pressure are done periodically during stretching of said material.

* * * * *